US006257803B1

(12) United States Patent
McCabe et al.

(10) Patent No.: US 6,257,803 B1
(45) Date of Patent: Jul. 10, 2001

(54) THREE COMPONENT CHEMICAL GROUT INJECTOR

(76) Inventors: Howard Wendell McCabe, 8470 Pinecone Dr., Idaho Falls, ID (US) 83401; William Ernest McCabe, 1160 Stanger Ave., Idaho Falls, ID (US) 83404

( * ) Notice: Subject to any disclaimer, the term of this patent is extended or adjusted under 35 U.S.C. 154(b) by 0 days.

(21) Appl. No.: 09/121,748

(22) Filed: Jul. 23, 1998

(51) Int. Cl.[7] ..... E02D 3/12
(52) U.S. Cl. ..... 405/269
(58) Field of Search ..... 405/269, 258, 405/266, 267, 268

(56) References Cited

U.S. PATENT DOCUMENTS 4,302,132 * 11/1981 Ogawa et al. ..... 405/269
4,449,856 * 5/1984 Tokoro et al. ..... 405/269
4,624,606 * 11/1986 Nakanishi et al. ..... 405/269
4,859,119 * 8/1989 Chida et al. ..... 405/269
5,123,782 * 6/1992 Yoshida et al. ..... 405/269
5,343,968 * 9/1994 Glowka ..... 405/269
5,423,636 * 6/1995 Mo ..... 405/269

* cited by examiner

*Primary Examiner*—David Bagnell
*Assistant Examiner*—Frederick L. Lagman
(74) *Attorney, Agent, or Firm*—Risto A Rinne, Jr.

(57) ABSTRACT

An apparatus and method for injecting grout is described as having an injector body with at least three holes therethrough for conveyance of a first, second, and third fluid as desired. One of the fluids is a resin and another is a catalyst which when combined, chemically react to produce a first chemical grout. A third fluid is an additive which, when combined with the resin and the catalyst, modify at least one characteristic of the first grout that is being produced. The introduction of the additive is controlled as desired at the surface to provide a continuous (monolithic) pour having variable grout characteristics. According to a modification, the additive is replaced by a second resin which when combined with the catalyst produces a second type of a grout having at least some characteristic that is different from the first grout.

41 Claims, 8 Drawing Sheets

THREE COMPONENT CHEMICAL GROUT INJECTOR

BACKGROUND OF THE INVENTION

1. Field of the Invention

The present invention, in general relates to a system and method for injecting chemical grout and, more particularly, to grout injection devices that accept three grout components simultaneously.

The use of chemical grout injection devices are, in general, known. They typically disclose methods and apparatus useful for injecting either a pre-mixed grout, such as cement, or for injecting two grout components simultaneously so as to create a chemical reaction that produces grout in-situ. Chemical grouts that require the mixing of two components are referred to as "binary" grouts.

Chemical "additives" are sometimes used with binary grouts to modify some characteristic of the resultant grout, for example the time it takes for the grout to set or cure. If the additive hastens the time required to set, it is commonly known as an "accelerator". Usually, the additive is included as a mixture in solution with one of the two principle component parts before they are combined (and reacted together).

When grout is being injected into an area in which a pervasive flow of water exists, such as is found under or around water dams or through cracks in the dam structures, the water will be flowing at great volume and under great pressure. If the grout being used under such or similar circumstances were of a slow set (cure) time, the pervasive flow would simply carry the grout away as soon as it is injected, never being able to stop the flow or to seal the crack.

For a greater understanding of this problem and of certain prior solutions, U.S. Pat. No. 5,342,149 to McCabe et al, that issued Aug. 30, 1994, is useful and is herein incorporated as a reference.

An especially fast setting grout is required under such conditions. In particular, the binary grout components must be reacted so as to form an especially fast setting grout which is used to form an immediate barrier that can obstruct the pervasive flow. Accelerators are likely required to hasten setting time of even the fastest curing binary grouts.

Although the terminology is not elegant, a "glob" of especially fast setting grout must be formed as it is injected into a crack or crevice or fissure (each term is used interchangeably herein) in order to stop the flow. The grout must set-up and adhere to the surrounding structures before the pervasive flow can carry it away.

The necessity to inject an especially fast setting grout to seal a pervasive flow creates two inherent problems. A very fast setting grout, by definition, sets up quickly. Once set, it can no longer flow. As the cited McCabe prior patent reference addresses, it is not possible to react a very fast setting grout at the surface and then pipe it to a location to be grouted because it would "set" in the pipe and cease to flow. Therefore, it must be reacted in-situ. That is the purpose of having an injector. The first problem, then, is the need to react a fast setting grout in very close proximity to the crack or crevice to be filled with grout.

If a crack or crevice that is sealed is, in fact, sealed using only an especially fast setting grout, the crack or crevice will not be entirely filled by the grout. This is a second problem that is encountered when using an especially fast setting grout.

The tendency of the especially fast setting grout to form a "glob" does not stop once the pervasive flow is stopped but rather continues as more grout is injected into the crevice. Therefore, minute crevices are not adequately filled by the fast setting grout and voids can occur in even larger areas that are to be filled. Indeed, a series of adjoining "globs" can be formed that may provide a poor fill pattern.

Test core samples that may be drilled and extracted after to determine the quality of the grouting operation may contain excessive voids, possibly not satisfying predetermined specifications, and possibly even causing penalties to be incurred by the grouting contractor.

Indeed, the various "globs" may not completely stop the flow. A lesser volume of fluid (typically water) may find various paths around the "globs" and may continue to flow. This is worse than it seems. The mere fact that any flow might continue means that erosion will occur which, in time, can only exacerbate the problem.

The ideal solution is to vary the setting time of the resultant (reacted) grout during actual grouting operations. This has not been accomplished in the past because there has been no way to inject an additive, for example to hasten the set time to initially seal a pervasive flow and then gradually reduce or even eliminate the amount of additive that is being combined with the binary grout components as they are reacted.

Prior art has required that the fast setting grout be injected to seal the pervasive flow and then to either continue to seal the opening with the fast setting grout as best as can be accomplished or, alternatively, to stop the grouting process, readjust the grout mix by eliminating the additive from one of the two grout components (before they are reacted), and then to restart the grouting process anew.

To restart the process with a different grout "mix" results in a lack of continuity and a break in the integrity of the grout seal as the first "fast setting" grout will have set and created an interface (surface) against which the next round of grout must make contact. This can result in a path that can encourage additional or future leaks to occur as, for example, the water from a water dam eventually migrates under pressure to take advantage of the dissimilar grout interface. If the grouting process is continued with the fast setting grout, voids, as was described above, can form.

A monolithic pour (i.e., a continuous pour) is desirable to prevent a grout interface from being formed, yet no known way has heretofore been developed to do this that can actually vary the grout formulation and thereby vary the fill characteristics during the process of reacting and injecting grout, referred to herein as either injection or during the "pour".

One ideal solution, if it were possible, would be to allow varying the amount of additives that are used so as to initially provide a grout mix with an especially fast setting time to initially seal the crack enough to stop the pervasive flow, and to then vary the amount of additives "on the fly" so as to provide a grout mix with a slower setting time, but with better fill characteristics. If no cessation of grouting occurred, a monolithic pour having optimum fill characteristics would result.

As mentioned briefly above, prior types of two component grout injectors require that the desired additive be first mixed together with one of the two binary components. When a long hole is included, a great deal of pipe intermediate the surface and the old injector will be filled with the additive mixed together with one of the grout components. If the process is stopped and later restarted without the use of the additive, a great deal of wasted "mix" containing the additive results in one of the pipes as well as the need to reclaim the components during extraction of the injector. The risk of spillage at the surface also arises as is discussed in greater detail hereinafter.

A second ideal solution, if it were also possible, would be to vary the grout formulation (i.e., the type of grout provided by a manufacturer) that is being injected (used) without stopping the grout injection process.

For example, various types of binary urethane chemical grouts, aside from the additives that may be used with them, when reacted produce grouts that have different characteristics as is well known among those having ordinary skill in this art. Some grouts set more quickly than others (without the use of accelerators) because the setting time is an attribute of the particular formulation of grout that is being sold under any of various trade names. These various kinds of chemical grouts are available from the various manufacturers, again as is well known in the arts.

Some of these off-the-shelf grouts will adhere better to rock and cement formations while others will make a better bond with sediments, such as might be found under leaking water dams. Some are more flexible and can better tolerate movement of the structure such as might occur with further "settling" or shifting. This might happen in areas that are prone to earthquakes. Some off-the-shelf formulations produce a grout that is more rigid and may be useful for chemical grout applications where it is desirable to provide a grout having exceptional structural integrity. This may be especially useful in areas where the structure may be under load or may experience an increased load due to further settling or erosion.

Clearly, varying the type of grout that is used would also be especially useful as a method to improve the grouting operation. To do this most effectively, it is desirable to vary the grout formulation, again "on the fly" so as to produce a monolithic pour comprised of various grout formulations.

For example, to stop a pervasive flow injecting a fast setting grout formulation might be required to stop the flow followed by a shift to one having good flexibility and fill characteristics, but with a slower set time. Similarly a fast setting grout might be followed by a shift to one having the ability to permeate into the sediment or one that provides a more rigid grout formation. This order could, ideally, be reversed whenever it is desirable.

As is described in greater detail hereinbelow, the use of a tube-a-manchette" piping system may require the use of isolation packers for optimum results. The isolations packers isolate the various areas that are to be grouted and are themselves filled with grout. It is sometimes desirable to be able to fill one or more of the isolation packers with one particular grout formulation and to then inject a different type of grout formulation into the areas that are adjacent to the isolation packers.

Therefore, it is also desirable to be able to inject various grout formulations simultaneously (without having to extract the injector and piping) when using a tube-a-manchette piping system. This can improve efficiency and safety while also optimizing the grouting operation.

A way is needed to deliver any of three components through an injector and to be able to modulate in real time the introduction of those components at the injector. Ideally this control would take place at the surface where the workers are disposed. The three components can include the resin and the catalyst (usually water) and an additive, or if preferred another resin in place of the additive so as to provide an entirely different grout formulation.

If a fast setting grout were initially so injected, a change in pressure and delivery rate would alert an operator at the surface that the pervasive flow has been stopped or at least slowed down sufficiently so as to permit varying the amount of additive required or shifting from a fast setting grout to another type of grout to better satisfy the job requirements. Accordingly, the resultant grout could be varied to provide an optimum grout formulation and fill pattern for each site in exact accordance with the needs of that particular site. Some of the variables would be anticipated and initially set prior to the commencement of grouting, such as the general types of grout that are to be used and any additives that may be used. However, the actual variations in grouting must be able to occur as grout is being injected into the crack or crevice to produce a monolithic pour that is able to stop a pervasive flow and also provide an optimum formulation for the job at hand.

Also, there is another need as was mentioned briefly hereinabove that relates to injecting grout via a "sleeve-port" type of grout pipe that is also commonly referred to by the French term "tube-a-manchette". Sleeve-port grout pipes allow for the precise location and injection of grout at a predetermined depth along a plurality of spaced apart locations where there are "sleeve-ports" formed into the "tube-a-manchette" pipe for that purpose. However, these pipes which are small, typically 3 to 6 centimeters in diameter and more often two inches in diameter, do not readily accept larger types of grout injection devices.

Indeed, the standard prior art use of the "tube-a-manchette" system relies upon a simple pipe that is used to inject a pre-mixed grout directly into the crevice. The use of two pipes that are joined together in a "Y" configuration and which inject two grout components directly into a spiral mixer (to react them) is known generally, but not specifically for use with the tube-a-manchette piping system.

The prior art use with the tube-a-manchette includes a single pipe inserted into the tube-a-manchette and having a double packer, one packer disposed in front of and another disposed behind a pipe segment that includes holes (is ported) to allow discharge of the grout to occur. The prior art injection pipe is then inserted into the "tube-a-manchette" until the "ported" pipe segment portion aligns with the desired sleeve-port. See FIG. 15 for a diagram of the prior art.

Grout is pumped in through the injector pipe and out through grout holes or "ports" that are drilled through the wall of the "tube-a-manchette" pipe at predetermined spaced apart locations, wherever it is desirable to be able to inject grout. The ports are located at the sleeve-port locations.

The ports are each covered by a tightly fitting rubber sleeve that is disposed around the outside portion of the "tube-a-manchette" and which functions as a one-way check valve. The rubber sleeve, functioning as a one-way check valve, allows grout to be pumped out through the ports (grout holes) under pressure by pushing the rubber sleeve sufficiently far away from the "tube-a-manchette" so as to create a channel for the grout to exit from the grout holes.

The rubber sleeve, when grout is not being pumped out under pressure, forms a tight seal around the "tube-a-manchette" that prevents the entry of other objects or fluids into the "tube-a-manchette", such as water which may be present under pressure outside any of the ports.

The prior art injector pipe is inserted into the "tube-a-manchette" so as to align the end of the pipe with one of the sleeve-ports and grout is pumped down through the pipe and is injected.

A plurality of inflatable bags or collars are also typically inserted around the "tube-a-manchette" at spaced apart intervals, typically one every three to six meters, and are either inflated with a fluid to a predetermined pressure or they are filled with a grout, either cement or chemical grout, to provide a periodic seal and support structure surrounding the "tube-a-manchette" along its length. These inflatable bags are known as "isolation packers" and they divide the grout area into various areas.

The various areas that are formed allow for different grout formulations to be used as may be desired and also to water test, under pressure, the various areas before and after grouting to ensure that the grouting has in fact provided an effective seal.

One of the advantages of the tube-a-manchette system is that the tube-a-manchette pipe remains in the hole, because it is relatively inexpensive. A water test can then be performed by attempting to inject water in through any of the sleeve-ports and noting the resistance encountered by the pressure buildup that occurs. Water testing is accomplished by pumping water down through the pipe and out through one of the sleeve ports until a predetermined water pressure is attained at which water seepage is either not occurring or is less than a predetermined amount that is deemed as acceptable. This procedure can be used to verify that an effective grout seal has been formed in any of the areas intermediate any of the isolation packers.

In addition, the water test can thereafter be periodically performed to confirm the integrity of the grout seal. If any change has occurred which might warrant the injection of additional grout into any of the areas (between the isolation packers), the sleeve-ports in the tube-a-manchette can be used to regrout the areas. This provides a cost effective way to "maintain" a repair site.

If for example, future settling of a water dam foundation causes a previously grouted area to settle and to develop a fluid path (basically, a leak) that fails to hold pressure during the water test, it is possible to re-inject grout, perhaps a type of grout that flows easily, into the area thus "resealing" the area. Maintenance of the site is economically achieved.

It should be noted that if grout is injected under great pressure, it may be possible to fracture existing grout formations and conduct an additional supply of grout where it is needed. This is useful if the additional grout is needed some distance away from the tube-a-manchette.

During normal use of the tube-a-manchette system, grout is inserted into the injector pipe until that grouting operation is complete at a particular sleeve-port location (for a given area intermediate the isolation packers), at which time the injector pipe is moved (up or down) so as to align the injector portion with another sleeve-port location and the operation is repeated for the new area.

The "tube-a-manchette" allows for grout to be injected at any of the sleeve-port locations in any order, top to bottom or bottom to top and the ability to reapply grout at the same sleeve-port locations when desired. This makes the use of the tube-a-manchette piping system versatile.

However, the prior art, which does not rely upon the use of a valved injector with the tube-a-manchette pipe (for reasons as are discussed hereinabove) results in several problems. First, the use of especially fast setting grouts is limited because, if the grout is reacted at the surface, it will set in the pipe before it is injected.

Second, if two pipes were used in the tube-a-manchette and were joined together at the bottom with a "Y" adapter, and if a spiral mixer were then added, this would cause certain other problems to arise. This type of approach is known in the industry as "twin streaming" and is previously known for use in bore holes having a steel casing, but is not believed to be known for use with a tube-a-manchette pipe system.

If it were attempted with a tube-a-manchette, the grout would not be adequately reacted in the spiral mixer for reasons as are discussed in greater detail hereinbelow. Furthermore, the grout would tend to set-up and accumulate in and around the spiral mixer thus choking off the supply of grout and tending to seal the spiral mixer in position within the tube-a-manchette.

It may not be possible to extract the "Y" fitting, the double packer, and the spiral mixer from the tube-a-manchette pipe without it breaking off. If this occurs, future (maintenance) is rendered impossible. So too is the ability to grout, when it is advantageous to do so, from the top to the bottom of the tube-a-manchette.

As is well known in the arts, a temporary drill casing may be inserted into the bore-hole to provide stability under certain situations, into which the "tube-a-manchette" is inserted. Obviously, the temporary drill casing cannot block grout from escaping from the "tube-a-manchette", so it must be extracted from the bore hole prior to injecting grout.

The prior art "tube-a-manchette" approach requires the use of a small injector pipe that is inserted into the small "tube-a-manchette" pipe. The size (inner diameter) of the tube-a-manchette pipe is limited because the inflatable collars must, of necessity, be large than the "tube-a-manchette", or stated in another way, the "tube-a-manchette" must be smaller than the bore hole in order to accommodate the collars and, to a lesser extent, the rubber sleeves.

As was mentioned hereinabove for previous prior art tube-a-manchette applications, the injector pipe is a single pipe that is used to insert a single component grout. There is no room for known types of injectors which can both combine and mix (react) a binary type of a grout (two-component grout) in proximity to each sleeve-port and certainly no previously known way of using a three component injector under such space constraints.

Another problem inherent with known types of two-component grout injectors is that they may not adequately mix the grout components at the injection site, that is to say when the grout is reacted in-situ.

The reason for this is that known types of spiral, or "knife-edged" types of mixers mix by a process called inversion which results in a layering of the grout components by progressively dividing and recombining them in proportion to the number of elements of the mixer according to the power of 2. One element will result in one layer of the components being formed. Two elements will result in four layers total where the components are interlaced together. Three elements will result in eight layers that are interlaced together and so on.

As the space between the two packers of the "tube-a-manchette" and the spacing between the sleeve-ports each serve to limit the maximum possible length of any spiral type of a mixer that could be attached at the end of any conceivable two or more component grout injector, the number of elements are therefore limited and so too are the maximum number of layers formed also limited. The more layers formed, the greater the likelihood that the various components will adequately contact each other and be fully reacted.

Accordingly, there exists the likelihood that the grout will not be adequately layered and therefore it will not properly be mixed (reacted) prior to leaving the injector. If the injector is used with a "tube-a-manchette" piping system, the grout may not be fully reacted prior to leaving the "tube-a-manchette".

Not fully reacted grout components are worse than useless in that they take up space in the crevice without providing any additional strength or sealing characteristics. As such they impede the sealing of cracks and crevices that are to be grouted.

Therefore, there is a need to be able to react grout components better in two or three component types of injectors so that less reliance upon the spiral mixer is required. This need is especially acute for use with the "tube-a-manchette" piping system.

Also, the longer the spiral mixer must be, the greater the tendency is that the grout will begin to set up in the spiral mixer and cease to flow therefrom, thereby giving a false indication, by a rise in operating pressure, suggesting that the area has been sealed with grout when, in fact, the spiral mixer is clogged.

Also, the longer the spiral mixer is, the harder it is to clean or "flush" grout therefrom for use at the next station (sleeve-port location). Therefore, the fewer elements that are needed in the spiral mixer, the easier it becomes to clean and move the injector to another sleeve-port location and also the less likely it is that grout will clog the spiral mixer.

As time is a critical factor with fast setting chemical grouts, a spiral mixer begins to react some of the grout immediately as the first layering occurs. Subsequent grout may not be reacted and yet the first layers may begin to set and, as was mentioned hereinabove, to clog the spiral mixer.

Any application involving the use of binary chemical grouts requires that the grout components be reacted both quickly and in a short distance. These requirements create a need to effectively augment the reacting of chemical grouts by means other than reliance upon the spiral mixer. To make a spiral mixer more effective it must be longer with more elements but this, in turn, increases the time the grout will remain in the spiral mixer and it also increases the length of the mixer, both of which are limiting factors.

Another set of problems associated with grout injectors, in general, is that certain of the components of a binary grout system tend to be either expensive or hazardous, and they may be especially hazardous if they are reacted together at which time they may emit toxic gases and noxious fumes. Typically, as an injector is raised, certain sections of pipe that are full of these components must be disassembled, thus exposing workers to their effects as the components are spilled onto the work area. It is desirable to be able to fully recover certain of the components without spillage occurring, and especially without spillage of the primary components (typically the resin) so as to prevent any inadvertent reaction.

As water is usually the catalyst and is harmless if spilled, it is fine if water is spilled at the surface when an injector is withdrawn from a "deep hole". The additives and resins are what must be protected from spillage, not only for safety reasons, but also for reasons of economy.

Another problem associated with prior art chemical grout injectors, and especially when used with fast setting chemical grouts, is the tendency for the reacted grout to begin to accumulate within the injector body itself, thus restricting flow and impeding further grouting. Ideally, if turbulence is created within the injector body, not only are the grout components more fully reacted, and in a shorter period of time, but the turbulence also tends to keep the injector clean. Therefore, internal turbulence can be used to self-clean a chemical grout injector.

One further problem encountered when injecting grout into a long hole (deep hole) is that outside of the injector (or tube-a-manchette), water may be present under pressure. The injector must include valuing to restrict the entry of water into the injector body and up into the supply conduits (which supply resin or additives to the injector). Yet the valving must be able to overcome the outside "head" pressure level. Ideally, in order to create a predetermined release pressure for grout injection to occur, the valving should be adjustable so that release of the grout can occur at any desired pressure.

If for example, injecting the grout with one-hundred pounds per square inch of positive pressure produces optimum turbulence in the injector, optimum reacting of the grout components, and optimum grout distribution, the valving would need to open at one-hundred pounds per square inch pressure if there is zero head pressure outside of the injector.

If there is fifty pounds per square inch of head pressure, the valving would need to open when the grout component pressure to the injector is one-hundred and fifty pounds per square inch, thus yielding the proposed ideal working (or operating) pressure of one-hundred pounds per square inch.

Similarly, if the head pressure were one-hundred pounds per square inch, then the valving would, ideally, need to open at two-hundred pounds per square inch applied pressure. Indeed, the valving cannot begin to open until the head pressure, which tends to keep the valving (valves) closed, as is described in greater detail hereinafter, is itself exceeded. If the head pressure is one-hundred pounds per square inch, the valving will not be capable of opening until the interior pressure (in the injector) exceeds the head pressure.

As the head pressure can be measured prior to any injecting of the grout, it is possible to know what the ideal opening pressure must be before use in order to create the optimum working pressure. Valving that can be adjusted prior to use is therefore most desirable.

Accordingly there exists today a need for a three component grout injector that is small, helps to mix grout components together, which can be used with a "tube-a-manchette" piping system, and which is safer, more economical, and versatile to use.

Clearly, such an apparatus is an especially useful and desirable device.

2. Description of Prior Art

Grout injectors and grout injection systems are, in general, known. For example, the following patents describe various types of these devices:

U.S. Pat. No. 4,302,132 to Ogawa et al, November 1981;

U.S. Pat. No. 4,449,856 to Tokoro et al, May 1984;

U.S. Pat. No. 4,710,063 to Faktus et al, December, 1987;

U.S. Pat. No. 4,859,119 to Chida et al, August, 1989;

U.S. Pat. No. 5,006,017 to Yoshida et al, April, 1991;

U.S. Pat. No. 5,100,182 to Norkey et al, March 1992; and

U.S. Pat. No. to McCabe et al, August, 1994.

The following foreign patents are also known:

Japan patent 115,416 that issued September, 1981, and

United Kingdom patent 2,063,337 that issued June, 1981.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a three component chemical grout injector that can be used with a "tube-a-manchette" sleeve-port type of piping system.

It is also an important object of the invention to provide a three component chemical grout injector that can fit into a small diameter pipe.

Another object of the invention is to provide a three component chemical grout injector that can fit into a two inch diameter pipe.

Still another object of the invention is to provide a three component chemical grout injector that is useful for injecting grout into a crevice or other area.

Still yet another object of the invention is to provide a three component chemical grout injector that can be used to inject binary grout into a crevice or other area.

Yet another important object of the invention is to provide a three component chemical grout injector that can be used to modulate a third component into a binary grout mixture to affect a characteristic of the binary grout.

Still yet another important object of the invention is to provide a three component chemical grout injector that can be used to modulate a third component into a binary grout mixture to affect the setting time of the binary grout.

It is another object of the invention is to provide a three component chemical grout injector that can be used to modulate the quantity of a third component that is being combined with a two component grout while injecting the grout into a crevice or other area.

It is another important object of the present invention to provide a three component chemical grout injector that can be used with a "tube-a-manchette" sleeve-port type of piping system to modulate a third component into a binary grout mixture to affect a characteristic of the binary grout that is ejected from the "tube-a-manchette".

It is another especially important object of the present invention to provide a three component chemical grout injector that can be used with a "tube-a-manchette" sleeve-port type of piping system to modulate a third component into a binary grout mixture to affect the setting time of the binary grout that is ejected from the "tube-a-manchette".

It is still another object of the present invention to provide a three component chemical grout injector that can be used with a "tube-a-manchette" sleeve-port type of piping system to modulate the quantity of a third component that is being combined with a two component grout while injecting the grout into a crevice or other area.

It is still one further object of the present invention to provide a three component chemical grout injector that can improve the mixing of grout components during injection.

It is still one further important object of the present invention to provide a three component chemical grout injector that can improve the mixing of grout components during injection by creating turbulence within the injector.

It is still one additional important object of the present invention to provide a three component chemical grout injector that can improve the mixing of grout components during injection by creating turbulence within the injector by the use of an abrupt shoulder disposed in the injector proximate the opening of a valve.

It is still one additional especially valuable object of the present invention to provide a three component chemical grout injector that can improve the cleaning of the injector during injection by creating turbulence within the injector.

It is a valuable object of the present invention to provide a three component chemical grout injector that includes a fluted valve guide.

It is another valuable object of the present invention to provide a three component chemical grout injector that can improve the mixing of grout components during injection by creating a sufficient amount of pressure within the injector to open a valve, thereby releasing a component under pressure.

It is a further valuable object of the present invention to provide a three component chemical grout injector that can be lowered into a bore hole and secured in position at the surface.

It is an especially valuable object of the present invention to provide a three component chemical grout injector that can be lowered to a predetermined depth in a bore hole by a plurality of sections of a specially designed pipe.

It is a still further valuable object of the present invention to provide a three component chemical grout injector that includes a specially designed pipe segment.

It is a still further especially valuable object of the present invention to provide a three component chemical grout injector that includes a specially designed pipe segment having a special shoulder and thread arrangement.

It is an additional object of the present invention to provide a three component chemical grout injector that includes a continuous hose that is attached to the injector and through which a component is delivered to the injector that can be lowered to a predetermined depth within a bore hole.

It is a further additional object of the present invention to provide a three component chemical grout injector that includes a continuous hose that is attached to the injector and through which a component is delivered to the injector that can be lowered to a predetermined depth within a bore hole and which includes a take-up reel for accumulating the hose at the surface.

It is an important further additional object of the present invention to provide a three component chemical grout injector that includes a pair of continuous hoses, each of which can be accumulated onto a reel at the surface, the hoses being attached to the injector and through each a fluid component is delivered to an injector that can be lowered to a predetermined depth within a bore hole and raised therefrom.

It is a very important further additional object of the present invention to provide a three component chemical grout injector that helps prevent the spillage of components at the work site.

It is an especially important further additional object of the present invention to provide a three component chemical grout injector that is safer to use.

It is an especially valuable further additional object of the present invention to provide a three component chemical grout injector that is easier to use.

It is a desirable object of the present invention to provide a three component chemical grout injector that helps to react grout in a short distance.

It is another desirable object of the present invention to provide a three component chemical grout injector that helps to react grout in short period of time.

It is one other desirable object of the present invention to provide a three component chemical grout injector that uses turbulence to self-clean itself.

It is one further desirable object of the present invention to provide a three component chemical grout injector that can be adjusted to compensate for head pressure.

It is yet another desirable object of the present invention to provide a method for providing a continuous monolithic grout formation of a desired composition in a given area.

It is yet one other desirable object of the present invention to provide method for providing a continuous monolithic grout formation of a desired composition in a given area.

It is yet one other desirable object of the present invention to provide method for method for alternating which of two grout resins is to be injected.

Briefly, an injector apparatus for use in reacting and injecting a grout into an area that is constructed in accordance with the principles of the present invention has a cylindrical injector body under two inches in diameter that includes an injector cap attached to a first end of the cylindrical injector body. The injector cap includes a cone shaped interior with three recessed arcuate shoulder areas that are disposed at the greatest diameter end of the cone shaped interior. The recessed arcuate shoulder areas provide room for any of three valves to partially extend from each of three valve seats that are formed in the first end of the cylindrical injector body. The shoulder area is also used to create increased turbulence for better mixing (reacting) of the grout components. The widest area of the cone interior of the injector cap abuts the cylindrical injector body proximate the valves and is attached thereto by a plurality of bolts and includes an o-ring seal intermediate the injector cap and the cylindrical injector body.

A spiral mixer is attached to the injector cap at the end opposite to where the injector cap is attached to the cylindrical injector body. The narrow end of the cone interior directs grout into the spiral mixer where it is mixed by a process called inversion. The mixed (reacted) grout is then ejected from the opposite end of the spiral mixer and out from the injector.

Two hose connections and one pipe connection are attached to the cylindrical injector body at a second end that is opposite the first end. Intermediate the first and second ends of the cylindrical injector body are three fluid holes that are bored from the second end into the cylindrical injector body, each of the three fluid holes intersecting with one of the valve seats proximate the first end of the cylindrical injector body and each of the three fluid holes being threaded at the second end of the cylindrical injector body. The three fluid holes are disposed around a central longitudinal axis of the cylindrical injector body equidistant with respect to each other.

Three valves are provided, each within one of the fluid holes and each including a valve stem. Each valve includes a threaded portion at a distal end of the valve stem and a proximate enlarged tapered head. The tapered head of each of the valves includes a screw driver slot at a flat portion of the tapered head to aid in assembly.

Each of the three valve seats include a matching conical area provided in the cylindrical injector body that cooperates with the tapered head of the valve in a closed position to provide a seal that prevents the passage of a fluid through the injector when the valve is in the closed position and permits the passage of a fluid when the valve is extended in an open position.

A portion of each valve stem passes through a fluted valve guide. The fluted valve guide includes a central hole through which a portion of each valve stem is adapted to slide longitudinally. Each fluted valve guide allows for the passage of the fluid intermediate the flutes of the fluted valve guide and the fluid hole. The fluid is conducted to the valve where a recessed area is provided that includes a larger hole that is bored partially into the end of the valve guide and which serves to elevate the fluted valve guide above the valve seat and thus permit the fluid to bear fully against that portion of a valve head that is exposed within the valve seat.

A coiled spring bears against the valve guide at one end and against a lock nut at the opposite end to supply a force that normally urges each tapered head of each valve to remain seated tightly against each of the valve seats in the closed position. When the pressure of one of the fluids (typically a grout component or an "additive") increases to a sufficient amount it urges one of the valves to extend into the open position by further compressing the coiled spring and allowing for the release of the fluid into the cone shaped interior of the injector cap and through the spiral mixer.

A portion of each of two of the valve stems extends beyond the second end of the cylindrical injector body and into a pipe adapter, one end each of which is screwed into the threads of two of the three fluid holes that are disposed at the second end of the cylindrical injector body. A pipe-to-hose coupling is attached to each of the two pipe adapters at an end of the pipe adapter that is opposite to where it is screwed into the second end of the cylindrical injector body. A continuous hose is attached to each of the two pipe-to-hose couplings at the injector. The two hoses are each connected to a hose reel having a swivel fitting at the surface at the opposite end.

A specially designed pipe adapter is screwed into the threads of the remaining of one of the three fluid holes that are disposed at the second end of the cylindrical injector body. A portion of the one remaining valve stem extends beyond the second end of the cylindrical injector body and into the specially designed pipe adapter. The specially designed pipe adapter includes male threads that cooperate with the female threads at the remaining one of the three fluid holes at the second end of the cylindrical injector body. The specially designed pipe adapter includes, at the opposite end, a specially designed shoulder having a specially designed female threaded end. The specially designed shoulder is used to cooperate with a specially designed male threaded end of a corresponding shoulder of at least one of a plurality of specially designed pipe sections. Each of the pipe sections repeats the corresponding female and male specially designed shoulder ends at each end thereof so that any number of pipe sections can be joined together. The pipe sections are of a predetermined length and are clamped at the surface to retain the injector in a desired position for use.

By careful measurement of the number and length of each of the pipe sections, the precise positioning of the injector into a bore hole is thereby accomplished. The pipe sections together form a pipe that is used to push or pull the injector into the desired position and to extract it from the bore hole. To push it further down into the bore hole additional pipe sections are added at the surface and additional hose length is played off of each of the take-up reels. To extract it, pipe sections are incrementally removed and each of the take-up reels are used to accumulate hose as the injector is pulled out of the hole by pulling on the pipe, and if desired, pulling slightly on the hoses.

Any of three components can be either individually or simultaneously injected. Normally at least two components are simultaneously injected and are partially reacted together by the turbulence that is created in the cone shaped interior of the injector cap due to the pressure required to open the valve and the movement that each of the shoulders introduces to the components. The components are more fully reacted in the spiral mixer.

The use of any desired "additive" may also be injected when desired simply by elevating the pressure in that particular supply line sufficient to open the valve and inject the additive as well. The quantity of additive or any of the components is varied at the surface by a pump that is used to supply each fluid (component or additive) under pressure. If desired, one of the three fluids (in either of the hoses or in the pipe) could be a cleaning solution (solvent) that is used to flush out the injector after use and may be used after injection of the grout has been accomplished.

DETAILED DESCRIPTION OF THE INVENTION

Figure 1:
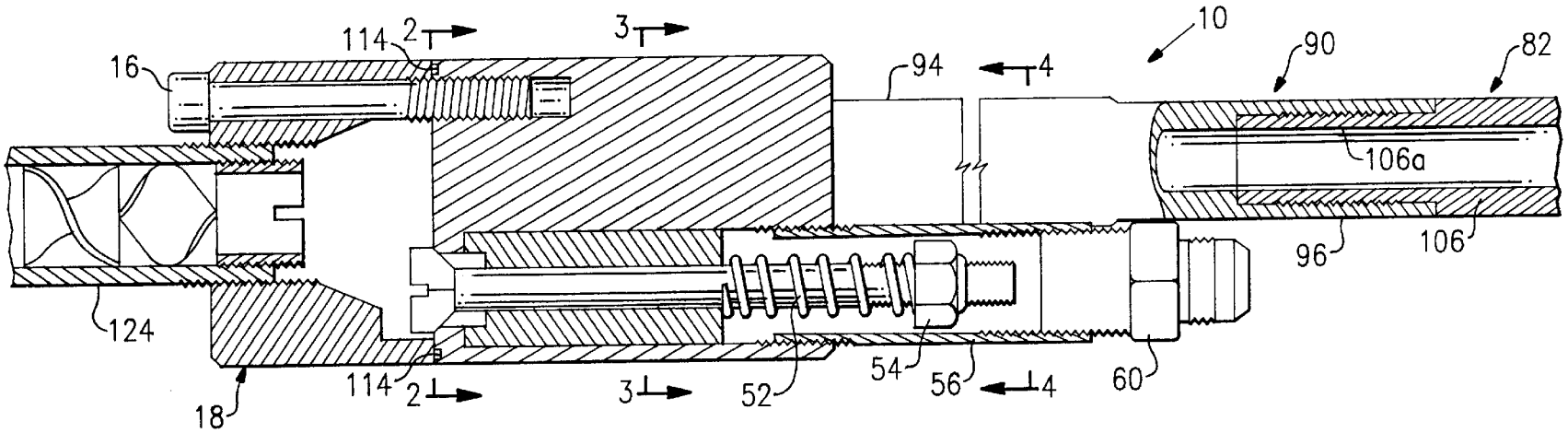
FIG. 1 is a cross sectional view of a three component chemical grout injector.

Referring to FIG. 1 and on occasion to all of the FIG. drawings is shown, a three component grout injector, identified in general by the reference numeral 10.

Figure 2:
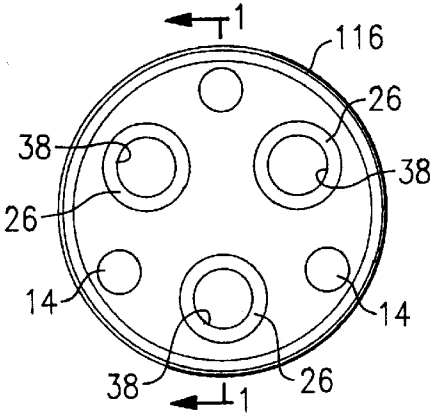
FIG. 2 is a cross sectional view taken on the line 2—2 in FIG. 1. The FIG. 2 view is of the entire injector and includes the missing half of the cross sectional view of FIG. 1.
Figure 5:
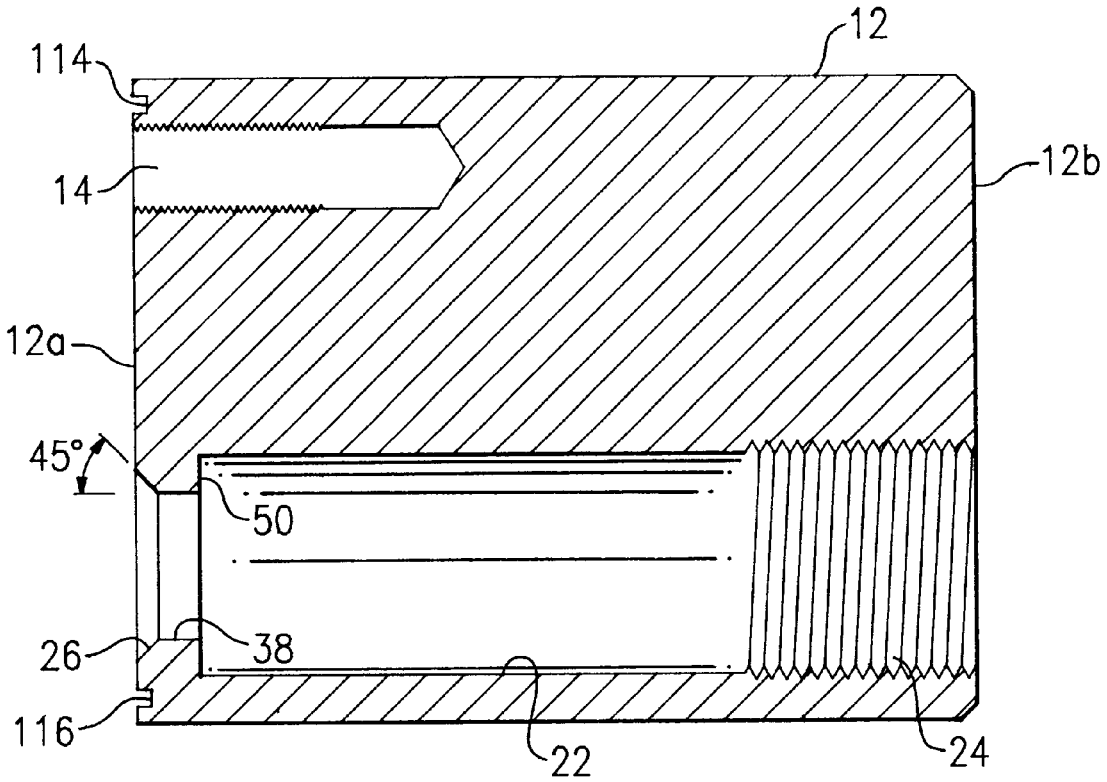
FIG. 5 is a detail of the cross sectional view of FIG. 1 of a cylindrical injector body of the injector.

A cylindrical injector body 12 is shown in FIG. 1 and again in FIG. 5 in cross sectional view taken on the line 1—1 of FIG. 2. A first of three threaded mounting holes 14 are shown into each of which a bolt 16 is used to secure an injector cap 18 to a first side 12*a* of the injector body 12, as is described in greater detail hereinbelow. A second side 12*b* is disposed opposite the first side 12*a*.

Figure 14:
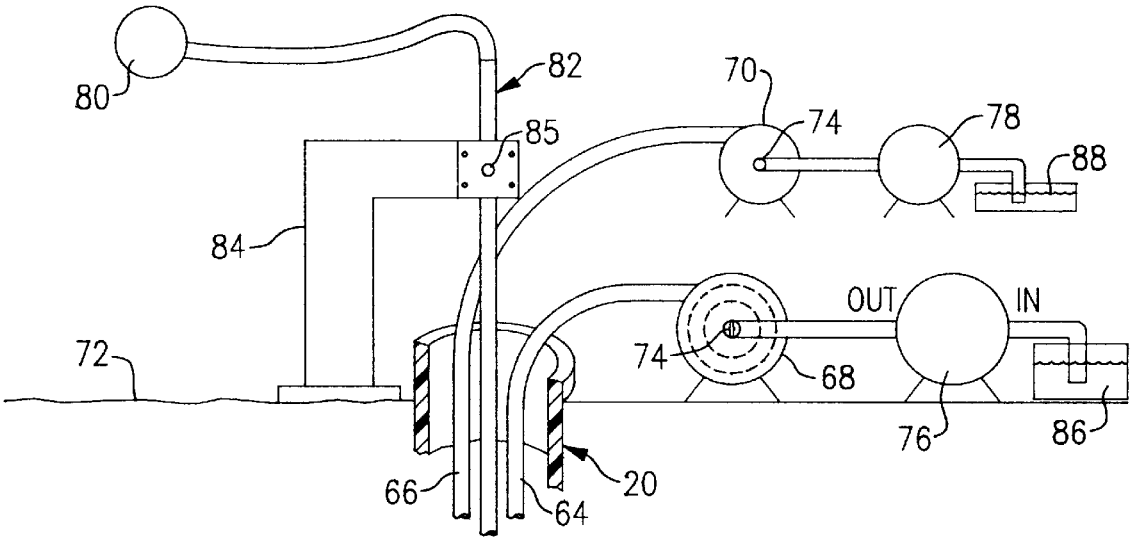
FIG. 14 is a partial view of the injector installed into a tube-a-manchette pipe system and injecting grout into an area to be grouted. Also shown at the surface are a clamp, take-up reels, pump, and a reservoir of component material.
Figure 14:
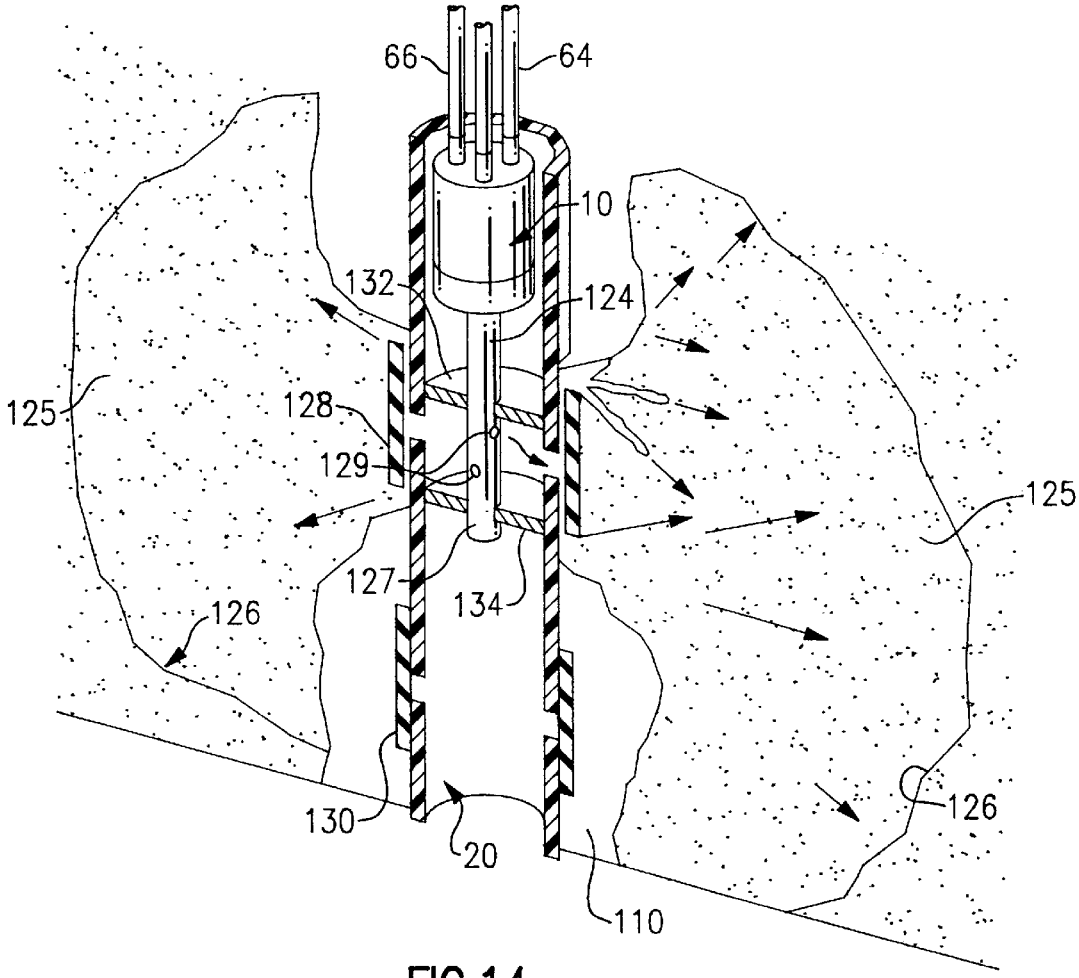
Figure 15:
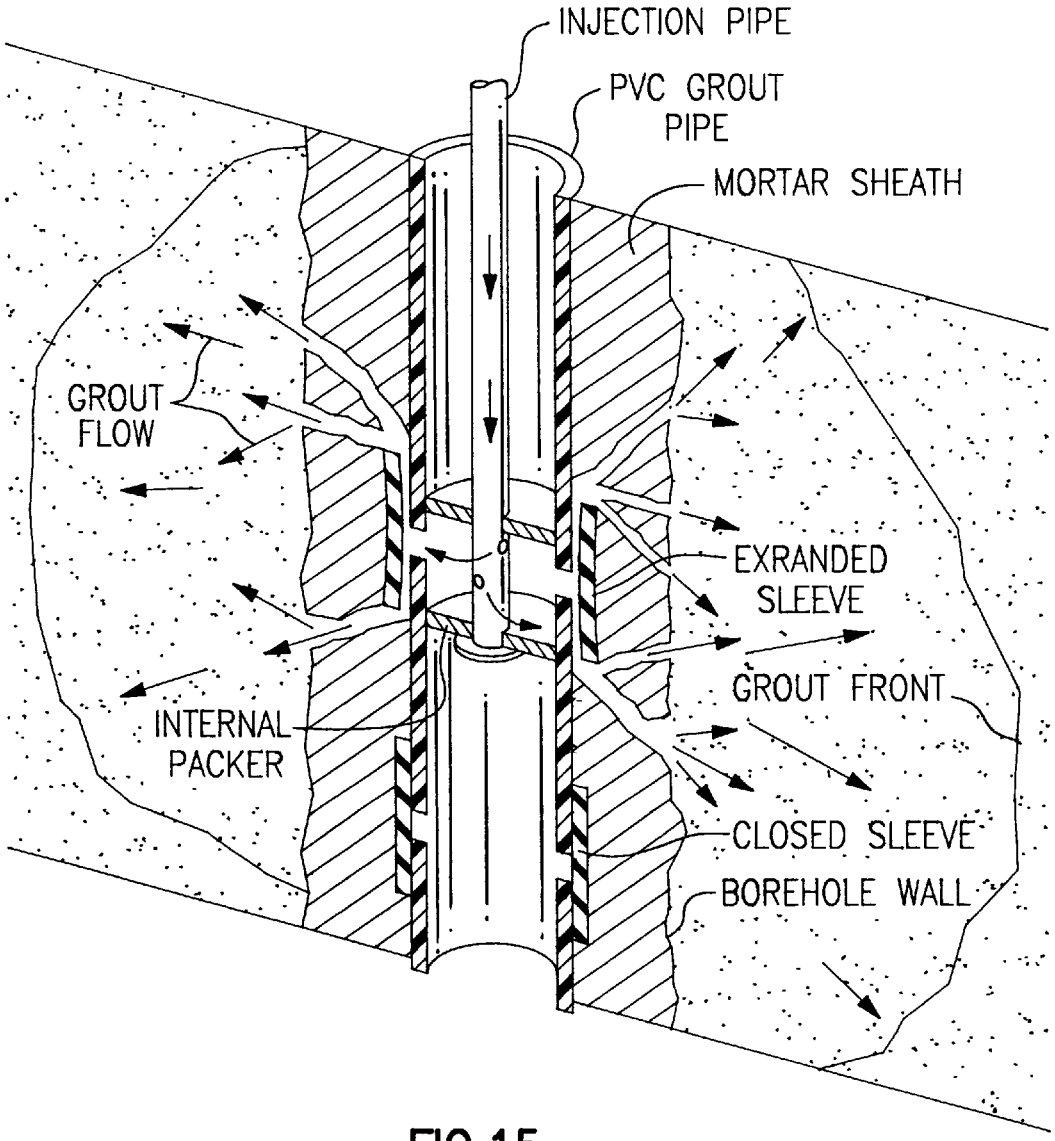
FIG.15 Prior Art
FIG. 15 is a view similar to that of FIG. 14 but showing the state of prior art for use with the tube-a-manchette system.

The injector body 12 as well as the rest of the injector 10 is designed to be under two inches in diameter to fit into a sleeve-port, or tube-a-manchette, pipe system as is shown in FIG. 14 and identified in general by the reference numeral 20. The terms sleeve-port and tube-a-manchette are used interchangeably herein.

Three fluid holes 22 are provided in the injector body 12 and are disposed equidistant from each other and at a predetermined distance from a central longitudinal axis of the injector body 12. A first female pipe thread 24 is provided at each of the fluid holes proximate the second end 12*b* of the injector body 12.

Figure 10:
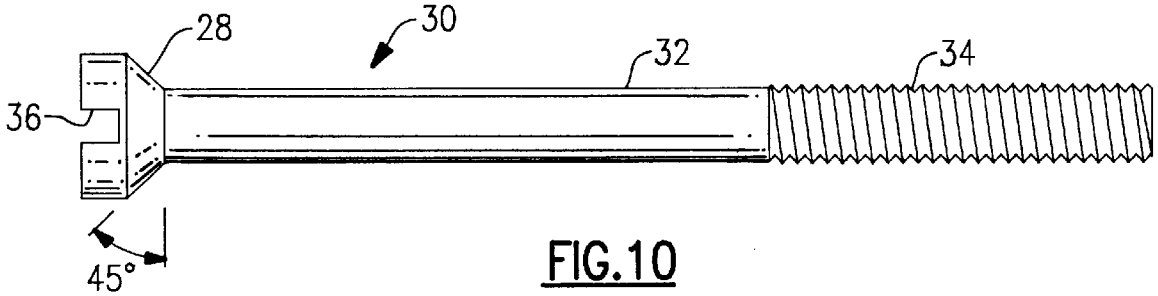
FIG. 10 an enlarged detail of a valve of the injector.

A valve seat 26 is provided at each of the fluid holes 22 proximate the first end 12*a* of the injector body 12 and includes a tapered conical area that is formed at approximately a 45 degree angle and which cooperates with a tapered head 28 of a valve 30 (FIG. 10). The valve 30 includes a valve stem 32 attached at a proximal end to the tapered head 28 and male threads 34 at a distal end thereof. A screw-driver slot 36 is included in the tapered head 28 at an end opposite to where the tapered head 28 is attached to the valve stem 32.

Each of the three fluid holes 22 that are provided in the injector body 12 include a smaller diameter section 38 intermediate the larger diameter portion of the fluid hole 22 and the valve seat 26.

Figure 11:
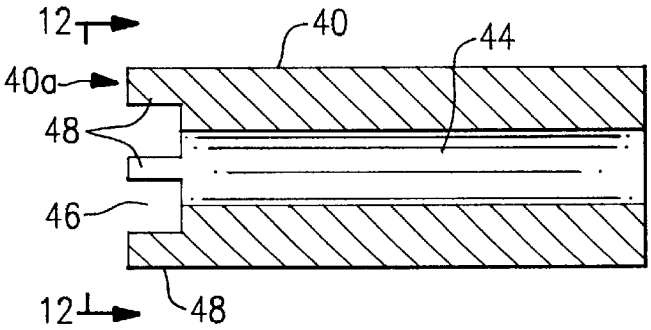
FIG. 11 is an enlarged detail of the cross sectional view of FIG. 1 of a valve guide of the injector.
Figure 12:
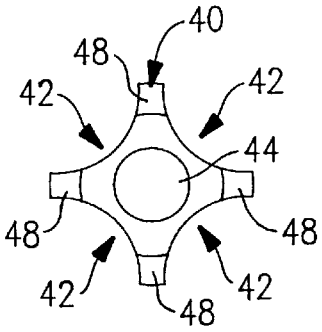
FIG. 12 is a side view of the injector cap taken on the line 12—12 in FIG. 11. The FIG. 12 view is of the entire injector and includes the missing half of the cross sectional view of FIG. 11.

Three fluted valve guides 40 are provided in each of the fluid holes (See FIGS. 11 and 12) and include a plurality of flutes 42 and a central valve hole 44 that passes through each of the fluted valve guides 40 concentric with a central longitudinal axis thereof. Ideally, the fluted valve guides 40 are made of brass for two principle reasons. First, brass is easier to machine than steel and therefore is less expensive. If other processes, such as casting, are eventually used to form each of the fluted valve guides 40, then this becomes less important of a consideration. Also, the use of dissimilar metals prevents galling from occurring as the valve stem 32 slides longitudinally within the central valve hole 44. Each of the fluted valve guides 40 includes a larger diameter hole 46 that is bored into a first end 40*a* to a predetermined depth resulting in four legs 48, each corresponding with one of the flutes 42. Of course, if more or less than four flutes 42 were included in any of the fluted valve guides 40, then a correspondingly greater or lesser number of legs 48 would occur. A second end 40*b* is disposed opposite the first end 40*a*.

The four legs 48 each rest on a ridge 50 (FIG. 5) thus allowing a fluid, as is described in greater detail hereinbelow, to flow through the flutes 42 of each of the fluted valve guides 40 and to contact a portion of the tapered head 28 of the valve 30.

A coiled spring 52 is disposed over the valve stem 32 and bears against the second end 40*b* of the valve guide 40 at a first spring end and against a lock nut 54 at an opposite second spring end.

The lock nut 54 is either tightened or loosened with respect to the valve 30 to adjust the force that is required to compress the coiled spring 52 and allow the valve 30 to slide longitudinally within the fluted valve guide 40 and open the valve 30 to allow the passage of the fluid to occur through the valve 30.

If the lock nut 54 is tightened, the coiled spring 52 is tightened and a greater force is required to open the valve 30. If the lock nut is loosened, then conversely a lesser force is required to open the valve 30. The force required can be readily calculated by determining the spring constant "k", the amount of compression of the spring, the area of the tapered head 28 that the fluid is in contact with to determine the pressure (for example in pounds per square inch) that is required to open the valve 30.

It has been determined that if the force required to open the valve 30 is approximately 300 pounds per square inch of pressure by the fluid, that not only will the valve 30 readily open but that amount of pressure will increase turbulence as the fluid exits from the valve 30 which, in turn, will help react the grout components (which comprise at least two of the fluids).

Accordingly, in a small confined area a valve assembly is provided that includes the valve 30, the fluted valve guide 40, the spring 52, and the locking nut 54 disposed in each of the fluid holes 22 and cooperating with the valve seat 26 to allow the passage therein of the fluid under pressure.

Figure 4:
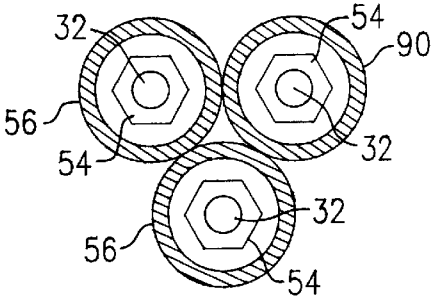
FIG. 4 is a cross sectional view taken on the line 4—4 in FIG. 1. The FIG. 4 view is of the entire injector and includes the missing half of the cross sectional view of FIG. 1.
Figure 3:
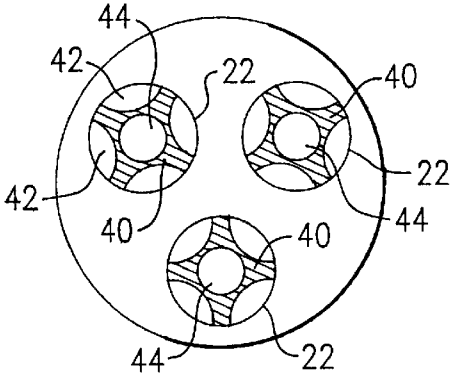
FIG. 3 is a cross sectional view taken on the line 3—3 in FIG. 1. The FIG. 3 view is of the entire injector and includes the missing half of the cross sectional view of FIG. 1.
Figure 6:
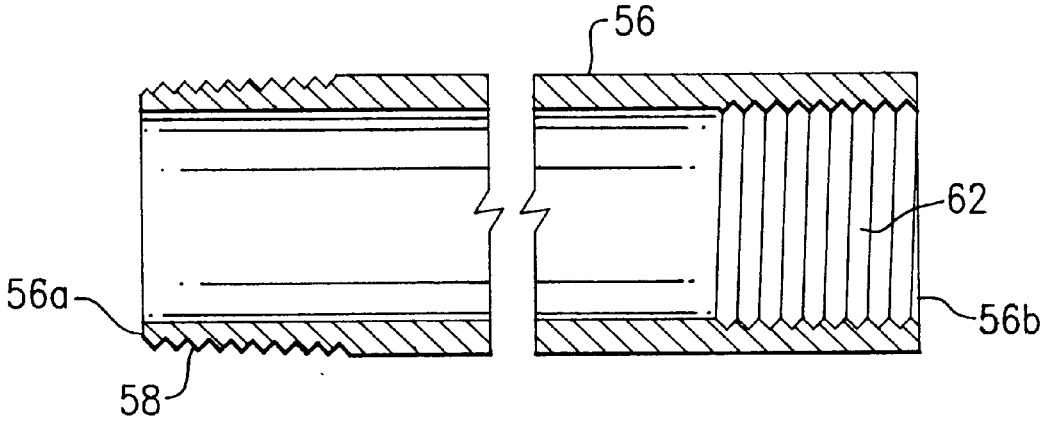
FIG. 6 is a detail of the cross sectional view of FIG. 1 of a pipe adapter of the injector.

A pipe adapter 56 is attached to the first female pipe thread 24 at one end 56*a* by male pipe threads 58 at two locations of the injector body 12 (See FIG. 4 and FIG. 6). A pipe-to-hose coupling 60 is attached at a distal end 56*b* to a second female pipe thread 62 of each of the two pipe adapters 56.

A first and second hose 64, 66 (See FIG. 14) are each respectively attached at one end to each of the two pipe-to-hose couplings 60 and to a first and second take-up reel 68, 70 at the opposite end thereof. The first and second take-up reels 68, 70 are each disposed on a work surface 72 and each include a swivel fitting 74 that allows the reels 68, 70 to turn so that they may either release or accumulate the first and second hoses 64, 66, as desired.

A first and second pump 76, 78 supply a determinable quantity of the fluid under a determinable pressure through the first and second hoses 64, 66 to the injector 10. Many designs for the first and second pumps 76, 78 are possible including pump designs that incorporate both pumping functions into one unit (not shown). A third pump 80 is used to supply another fluid, under pressure, through a pipe, identified in general by the reference numeral 82, to the injector 10, and is described in greater detail hereinbelow.

A clamp 84 is used to secure the pipe 82 in the desired position, and as will be understood, the injector 10 in the desired position. The clamp 84 is a typical "spider clamp" that includes a plurality of threaded clamp screws 85 disposed around the periphery of the clamp 84 that bear against the pipe 82 and secure it in position. Other types of clamps (not shown) are also anticipated for use including fast acting hydraulic types of clamps.

The three fluids that can be pumped are supplied as desired to each of the respective pumps 68, 70, 80 and if desired a first and second reservoir is provided 86, 88.

A specially designed pipe adapter assembly 90 (See FIG. 13) includes a third female pipe thread 92 that is adapted to cooperate with the remaining first female pipe thread 24. The pipe adapter assembly 90 includes a first pipe 94 and a second pipe 96 that are joined by a pipe weld 98.

The second pipe 96 includes a specially designed shoulder with a first 10 degree angle at an interior location 100 and a second 10 degree angle at an exterior location 102 with special female threads 104 disposed intermediate.

Figure 13:
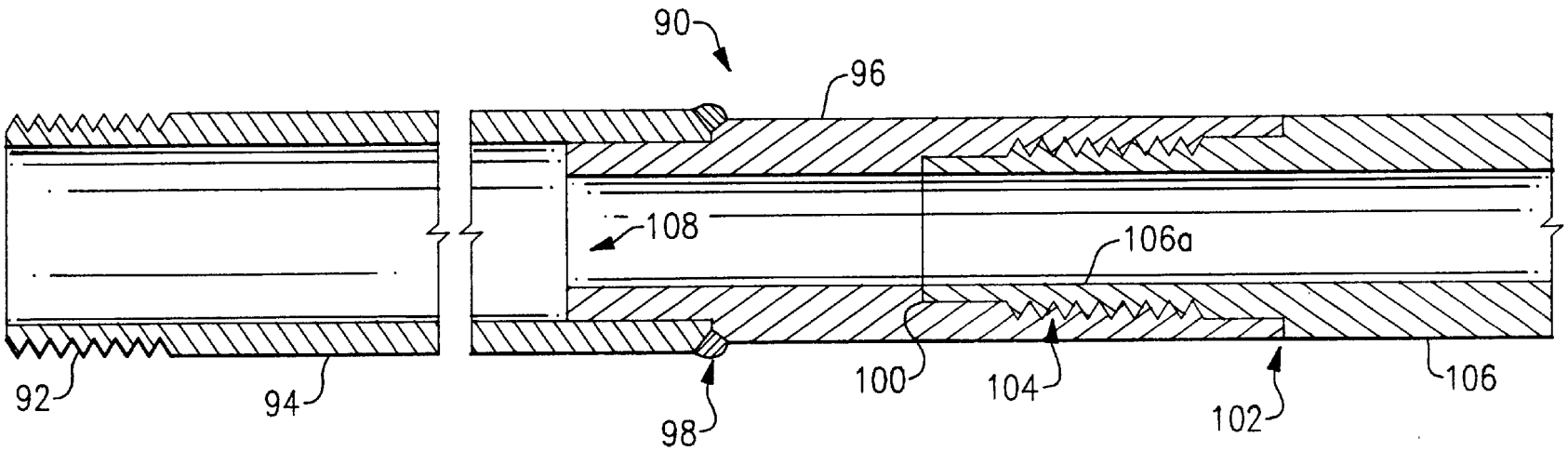
FIG. 13 is a detail of the cross sectional view of FIG. 1 of a specially designed pipe adapter assembly and it also shows one end of a specially designed pipe segment.

A first end 106*a* of a first specially designed pipe segment 106 is partially shown in FIG. 13 and in FIG. 1 so as to cooperate with specially designed shoulder of the second pipe 96 having corresponding male threads and 10 degree angles to cooperate with the interior and exterior locations 100, 102 of the second pipe 96 so as to form a seal.

This type of a connection is referred to as a "pin shoulder to box shoulder" interface and provides the necessary strength and pressure retentive seal along with an unobstructed conduit path, identified in general by the reference numeral 108. The "pin shoulder to box shoulder" provides two seals at both the interior and exterior locations 100, 102. It also builds tension which increases the structural strength of the actual interface.

As both the interior and exterior locations 100, 102 must make contact at the same time, the tolerances for these parts are typically controlled to within two thousandths of an inch, plus or minus during machining.

The first specially designed pipe segment 106 is of a fixed length, preferably 60 inches in length, and includes the same configuration of the specially designed shoulder with the first 10 degree angle at the interior location 100 and the second 10 degree angle at the exterior location 102 with the special female threads 104 disposed intermediate as is provided with the second pipe 96.

Accordingly any number of second, third, etc., specially designed pipe sections (not shown) can be joined together in series to provide the pipe 82 with the desired overall length.

The pipe 82 thus formed provides the conduit path 108 for a third fluid, and also provides a method to lower or raise the injector 10 to any desired location within the "tube-a-manchette" 20 that is itself first inserted into a bore hole 110 (See FIG. 14). The pipe 82 also provides a way to precisely determine the depth of the injector 10 because the overall length of the pipe 82 can be measured as it is assembled and the depth to which the injector 10 is lowered can be determined by simple correlation with the amount of the pipe 82 that is inserted into the "tube-a-manchette" 20.

Figure 8:
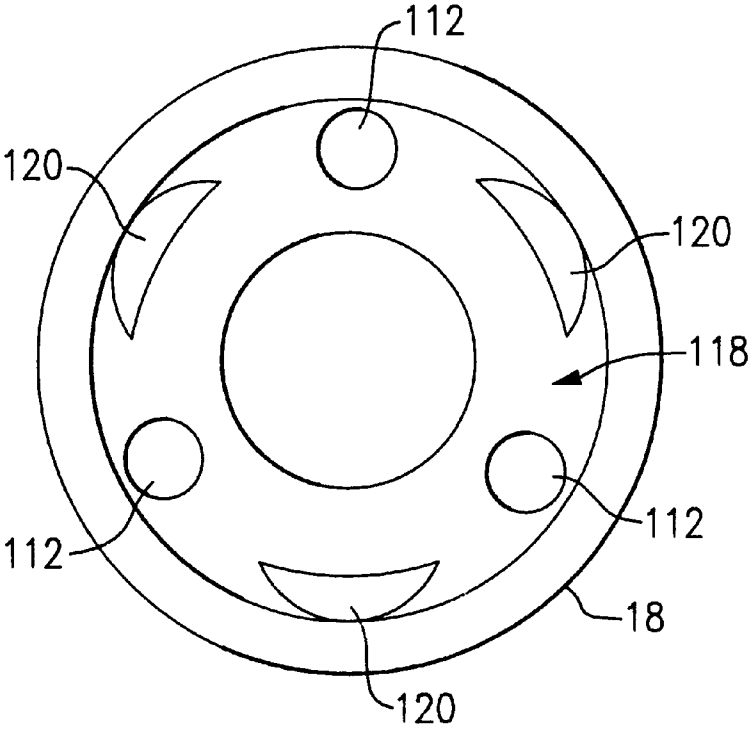
FIG. 8 is a side view of the injector cap taken on the line 8—8 in FIG. 7.
Figure 7:
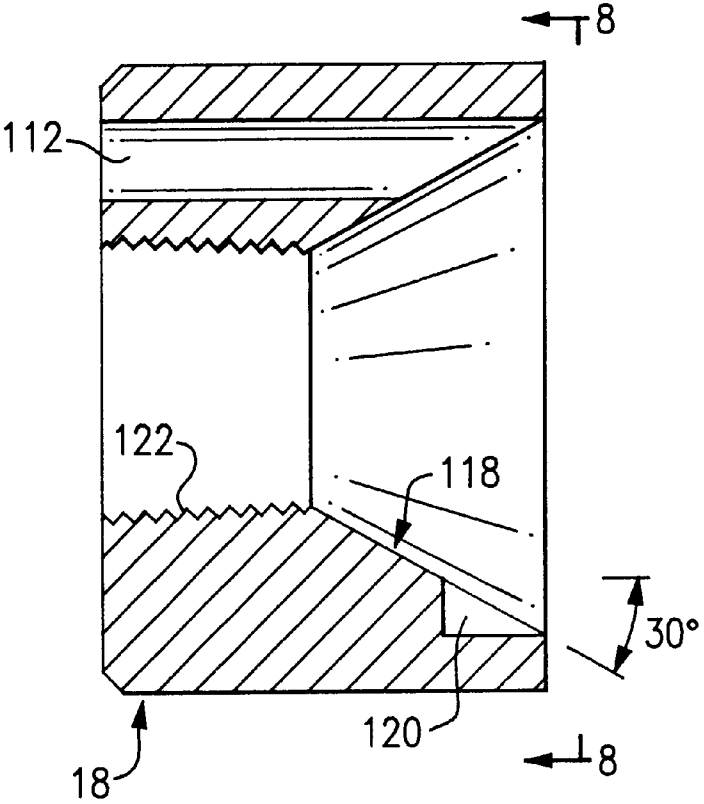
FIG. 7 is a detail of the cross sectional view of FIG. 1 of an injector cap of the injector.
Figure 9:
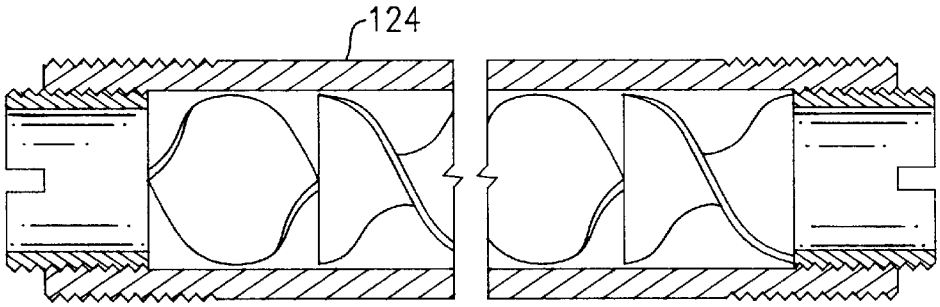
FIG. 9 is an enlarged detail of the cross sectional view of FIG. 1 of a spiral mixer of the injector, showing the entire spiral mixer.

Referring now also to FIG. 7 and FIG. 8, the injector cap 18 includes three bolt holes 112 through which each of the bolts 16 pass. An o-ring 114 fits into a recess 116 provided in the first side 12*a* of the injector body 12 to provide a seal intermediate the injector body 12 and the injector cap 18.

A cone shaped interior 118 is at its widest diameter at the end of the injector cap 18 that attaches to the injector body 12 and tapers to its minimum diameter near the center of the injector cap 18. The cone shaped interior 118 is at approximately a 30 degree angle with respect to a longitudinal axis of the injector cap 18.

Three shoulders 120 are provided in the injector cap 18 so as to align over the tapered head 28 portion of each of the valves 30. Each of the three shoulders 120 include an abrupt angle of approximately 90 degrees around which fluid under pressure (up to approximately 300 pounds per square inch as it escapes from the valve 30) must navigate. The shoulders 120 thereby serve to increase turbulence of each of the fluids as it exits from each of the valves 30 and enters into the cone shaped interior 118. The turbulence of the pressure and shoulders 120 agitates the fluids so that they begin to effectively intermingle and combine (react) in the cone shaped interior 118.

A fourth female pipe thread 122 is provided in the injector cap 18 at an end opposite to where it is attached to the injector body 12 and into which one end of a spiral mixer 124 is screwed. The spiral mixer 124 mixes the fluid components together to complete the reaction necessary to produce the chemical grout.

Operation

The injector 10 is lowered into position in the sleeve-port 20 by adding the desired number of specially designed pipe sections to the first specially designed pipe segment 106. It is secured at the desired position by the clamp 84 securing the pipe 82 relative to the surface 72.

The pressure of any of three fluids in either of the hoses 64, 66 or the pipe 82 is increased to initiate flow through the injector by opening the respective valve 30 as was described hereinabove. Typically, at least two fluid components must flow simultaneously and be reacted together in order to produce a chemical grout. See the reference for additional information concerning binary chemical grouts. The two essential components are known as a resin and a catalyst and when combined, chemically react to produce a grout. A two-part urethane type of grout is often preferred but the use of the injector 10 is not limited only to their use. The reaction takes place in the cone shaped interior 118 and the spiral mixer 124 before the grout so produced is ejected from the injector 10.

However, as desired, the injector 10 can be used to simultaneously introduce a third fluid component, usually called an additive, into the cone shaped interior 118 along with the two primary grout components (the resin and the catalyst) to vary some attribute of the grout being produced, for example to accelerate its setting time.

To seal a pervasive flow, the maximum predetermined preferred flow of all three fluid components (catalyst, resin, and additive) are initiated at the surface 72 to produce an especially fast setting grout, identified by the reference numeral 125, to seal the pervasive flow. An increase in pressure is monitored at the surface at which time an operator can elect to either reduce or eliminate the flow of the additive from the injector 10, thus producing a slower setting grout (also identified by the reference numeral 125 as no separation is created during grouting) that forms a continuous structure to seal a crack or void, each being identified by the reference numeral 126.

As shown in FIG. 14, the grout 125 passes through the spiral mixer 124 and into a ported pipe 127 that is threaded at one end thereof to the spiral mixer 124. The ported pipe 127 is open to allow the grout 125 to enter where it is attached to the spiral mixer 124 and it is closed at the opposite distal end. It includes a plurality of port holes 129 through which the reacted grout 125 is ejected out of the injector 10, in general, and out of the ported pipe 127 in particular. The grout 125, under pressure, is forced to exit out of the tube-a-manchette 20 at a first rubber sleeve 128 that has been extended (pushed open) under the pressure of the escaping grout 125.

A second rubber sleeve 130 is not under increased internal pressure and so it remains tight against the sleeve-port 20 piping system to act as a one-way check valve preventing the entry of substances from outside of the sleeve-port 20.

The ported pipe 127 includes a first packer 132 that is disposed around its periphery and intermediate the interior of the tube-a-manchette 20 proximate to where it is attached to the spiral mixer 124 to provide a first seal and it includes a second packer 134 that is disposed proximate the distal end of the ported pipe 127. Together, the first packer 132 and the second packer 134 each provide a first and second seal respectively which limits the introduction of the grout 125 to the area intermediate the first and second packers 132, 134.

As the grout 125 is being injected the additives that are used are varied as desired by turning on or off each of the first and second pumps 76, 78 and by controlling the quantity of fluids that are being introduced (pumped) in to the injector 10.

For example, assume that to begin sealing a crack having a pervasive flow, a chemical grout resin is being pumped in to the injector 10 through the first hose 64 and an additive used as an accelerator (to hasten set time) is being pumped in through the second hose 66.

It is important to note that the catalyst (water) is normally introduced through the pipe 82 because when the injector 10 is removed from the tube-a-manchette 20 and the sections which comprise the pipe 82 are disassembled, only water is spilled at the surface. Both the resin and the additive are saved entirely in the first and second hoses 64, 66 (without any spillage occurring) as they are accumulated on the first and second take-up reels 68, 70, respectively.

When a rise in working pressure is detected at the surface 72, this indicates that the pervasive flow has either stopped or been sufficiently slowed. An increase in pressure implies that a build-up of grout 125 has occurred in the area proximate the tube-a-manchette 20 and this build-up is causing added resistance to the introduction of more grout 125, thereby increasing working pressures which are reflected at the surface 72 (because the valves 30 in the injector 10 are open).

Depending upon the particular needs of the situation, an operator (not shown) would either stop or slow pumping of the additive in response to rise in pressure to provide a grout formulation that has better fill characteristics for filling in the remainder of the crack 126 (or fissure).

Alternatively, the first hose 64 may contain a first resin intended to provide an especially fast setting grout (for example) and the second hose 66 may contain another kind of resin, perhaps one with a slower set time but other desirable characteristics. If a continues pour is desired, then the operator would begin by injecting the first resin and catalyst to stop the flow and when noting a pressure increase, or perhaps even after a predetermined period of time has elapsed, he would momentarily begin the simultaneous introduction of the second resin and then stop injecting (pumping to the injector 10) any more of the first resin. He would then continue to completely fill the crack 126 with a grout formulation more ideally suited to the needs of the situation than if only an especially fast setting grout were used throughout the fill procedure. As can be understood, this procedure results in a continuous pour (or fill) operation. The grout formation (again identified in general by reference numeral 125) is a contiguous structure having no seams or interfaces yet containing different grout formulations.

The ability to modulate the introduction of a third component (either an alternative resin or an additive) from the surface provides a way to vary the grout formulation, and thereby the grout formation that is produced while maintaining a continuous (monolithic) pour, thereby providing an ideal grout pattern for any given chemical grouting situation.

Figure 16:
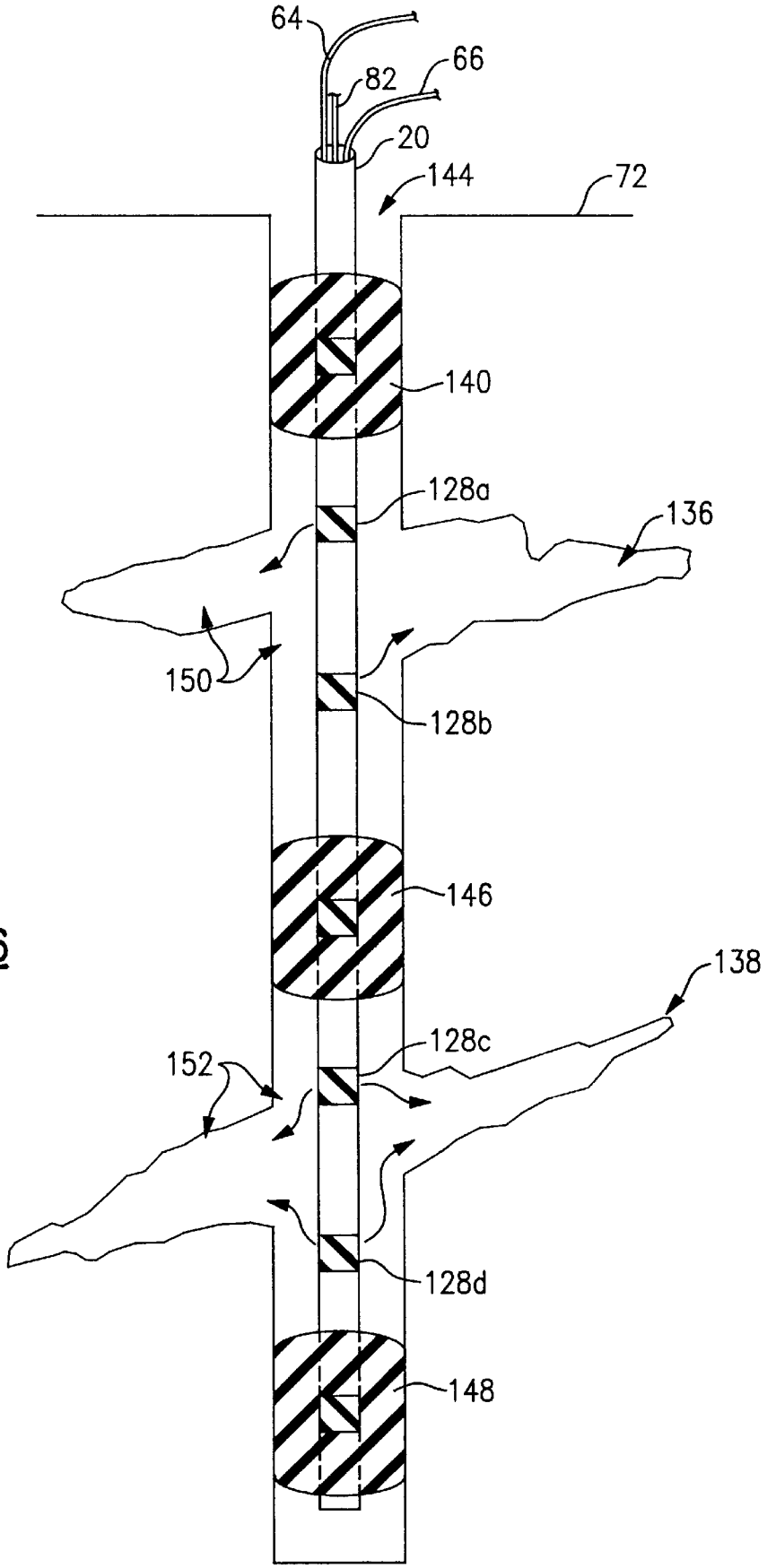
FIG. 16 is a cross-sectional view of a tube-a-manchette piping system installed in a bore hole with inflated isolation packers defining work areas ready for grout to be injected to seal a first and second crevice.

Referring momentarily to FIG. 16, the injector 10 (not shown in this view) is inside of the tube-a-manchette 20 along with the pipe 82 and the first and second hoses 64, 66. A plurality of rubber sleeves 128*a*, 128*b*, 128*c*, 128*d* remain exposed to inject the grout 125 to fill a first fissure 136 and a second fissure 138.

A first isolation packer 140 has been filled with the grout 125 through a first hidden rubber sleeve 142. The first isolation packer 140 was clamped around the first hidden rubber sleeve 142 before the tube-a-manchette 20 was installed in a bore hole 144. Then the injector 10 was lowered into position so that the ported pipe 127 which was surrounded by the first packer 132 and the second packer 134 was placed in alignment with the first hidden rubber sleeve 142. The grout 125 was then injected to inflate the first isolation packer 140 enough to form a bond against the surrounding material of the bore hole 144. The grout 125 used in the first isolation packer 140 (or any other isolation packer) may be formed using a particular resin so as to give a particular sealing characteristic for the first isolation packer 140. This may be a different resin than is used to seal either the first or second fissures 136, 138.

If desired, each of the first and the second resins may be present in the first and the second hoses 64, 66 and the injector 10 may be moved to inflate and seal all of the isolation packers (see below) in position using one of the resins. Then the injector 10 may be moved to complete the actual grout filling of the fissures 136, 138 using the remaining resin, again providing increased versatility.

The above described procedure for installing and filling the first isolation packer 140 is repeated for a second isolation packer 146 and a third isolation packer 148 creating a first and a second fill area, each being identified in general by the reference numerals 150, 152 and disposed external to the tube-a-manchette and intermediate the respective isolation packers 140, 146, 148. Typically, all of the isolation packers 140, 146, 148 would be filled each immediately following the other after the entire tube-a-manchette is in place.

Accordingly, the grout 125 can be injected, using the procedures described hereinabove to produce a monolithic pour, to fill, for example, the first fill area 150 including the first fissure 136 by injecting the grout 125 through either of the top two plurality of rubber sleeves 128*a*, 128*b*. The second fill area 152 would be similarly filled by injecting the grout 125 through either of the bottom two plurality of rubber sleeves 128*c*, 128*d*.

Alternatively, if it is desirable to be able to inject (and produce) the grout 125 at a maximal rate, the first or the second resins may be present in both the first and second hoses 64, 66 simultaneously assuming that a sufficient amount of catalyst is present to react all of the resin. As water is often the catalyst and it may itself be present in the work environment, such as with a pervasive flow, it is likely that a sufficient amount of catalyst will in fact be available. The ability to quickly produce and inject a large quantity of the grout 125 can itself be especially useful in stopping the pervasive flow.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A three or more component chemical grout injector, comprising:

(a) an injector body;

(b) means for attaching a first hose to said injector body;

(c) means for attaching a second hose to said injector body;

(d) means for attaching a rigid conduit to said injector body;

(e) first valve means for controlling the passage of a first fluid through said injector body and said first hose;

(f) second valve means for controlling the passage of a second fluid through said injector body and said second hose; and (g) third valve means for controlling the passage of a third fluid through said injector body and said rigid conduit.

2. The chemical grout injector of claim 1 wherein said injector body includes an injector cap attached at a first end of said injector body.

3. The chemical grout injector of claim 2 wherein said injector cap includes a tapered cone-shaped interior adapted for combining any of said first fluid, said second fluid, and said third fluid together.

4. The chemical grout injector of claim 3 wherein said cone-shaped interior is adapted for chemically reacting any of said first fluid, said second fluid, and said third fluid together to produce a grout.

5. The chemical grout injector of claim 3 wherein a wider portion of said cone-shaped interior is disposed proximate to said first end of said injector body and a narrower end is disposed distally from said first end of said injector body.

6. The chemical grout injector of claim 5 including at least one shoulder disposed in said cone-shaped interior proximate said wider portion thereof, said at least one shoulder adapted to receive a portion of any of said first, second, and third valves during the passage of any of said first, second, and third fluids through said injector body.

7. The chemical grout injector of claim 6 wherein said at least one shoulder includes an abrupt shoulder adapted for creating a turbulence within said injector cap during the passage of any of said first, second, and third fluids through said injector body.

8. The chemical grout injector of claim 5 including means for attaching a spiral mixer to said injector cap proximate said narrower end thereof.

9. The chemical grout injector of claim 8 wherein said spiral mixer is adapted for chemically reacting any of said first fluid, said second fluid, and said third fluid together to produce a grout.

10. The chemical grout injector of claim 9 wherein said spiral mixer includes means for ejecting a grout attached to said spiral mixer, said means for ejecting a grout including means for attaching a first packer and a second packer thereto.

11. The chemical grout injector of claim 8 wherein said spiral mixer includes means for attaching a first packer thereto.

12. The chemical grout injector of claim 11 wherein said spiral mixer includes means for attaching a second packer thereto.

13. The chemical grout injector of claim 1 including means for creating a turbulence within said injector.

14. The chemical grout injector of claim 1 wherein any of said first, second, and third valve means includes at least one fluted valve guide having a central valve hole disposed longitudinally through said fluted valve guide at the center thereof and wherein said central valve hole is adapted to be disposed around any of a corresponding first, second, and third valve stem and adapted to permit a longitudinal motion by any of first, second, and third valve stems therein.

15. The chemical grout injector of claim 14 wherein said at least one fluted valve guide is disposed in a fluid hole, said fluid hole providing an opening intermediate said first end and an opposite second end of said injector body.

16. The chemical grout injector of claim 15 wherein said at lease one fluted valve guide is adapted to permit the passage of any of said first, second, and third fluids along the longitudinal length of said fluted valve guide intermediate at least one flute and said fluid hole.

17. The chemical grout injector of claim 14 including means for adjusting a pressure at which any of said first, second, and third valve means opens.

18. The chemical grout injector of claim 17 wherein said means for adjusting a pressure includes a coil spring disposed around any of said first, second, and third valve stems and intermediate said fluted valve guide and a nut, said coil spring supplying a force tending to urge any of said first, second, and third valve means into a closed position, said nut being attached to corresponding threads disposed on an end of any of said first, second, and third valve stems whereby a tightening of said nut compresses said spring to a greater extent thereby increasing said pressure at which any of said first, second, and third valve means opens and whereby a loosening of said nut compresses said spring to a lesser extent thereby decreasing said pressure at which any of said first, second, and third valve means opens.

19. The chemical grout injector of claim 1 wherein any of said first and second hoses is a continuous flexible hose.

20. The chemical grout injector of claim 19 including at least one reel adapted for winding said continuous flexible hose thereon.

21. The chemical grout injector of claim 1 including at least one pump means for supplying any of said first, second, and third fluids under pressure to said injector.

22. The chemical grout injector of claim 21 wherein said pump means includes means for starting and stopping any of said at least one pump means.

23. The chemical grout injector of claim 21 wherein said pump means includes means for varying the pressure of any of said first, second, and third fluids.

24. The chemical grout injector of claim 21 wherein said pump means includes means for varying the rate of flow of any of said first, second, and third fluids.

25. The chemical grout injector of claim 1 including means for placing said injector within a hole.

26. The chemical grout injector of claim 25 wherein said means for placing includes urging said injector into said hole by said rigid conduit to a predetermined depth.

27. The chemical injector of claim 1 including means for securing said injector within a hole.

28. The chemical injector of claim 27 wherein said means for securing including means for clamping said rigid conduit proximate a surface opening of said hole.

29. The chemical injector of claim 1 wherein said rigid conduit includes a plurality of pipe sections of a predetermined length, each of said plurality of pipe sections including means adapted for attaching each of said plurality of pipe sections together.

30. The chemical grout injector of claim 29 wherein said means adapted for attaching includes threaded means.

31. The chemical grout injector of claim 30 wherein said threaded means includes a pin shoulder to box shoulder arrangement.

32. The chemical grout injector of claim 1 wherein said injector is adapted for placement within a tube-a-manchette piping system.

33. The chemical grout injector of claim 1 wherein said injector is adapted for placement within a sleeved-port piping system.

34. The chemical grout injector of claim 1 including means for modulating any of said first, second, and third fluids during injection of a grout.

35. The chemical grout injector of claim 1 wherein the injection of said first fluid simultaneous with said second fluid produces a grout.

36. The chemical grout injector of claim 1 wherein the simultaneous injection of any two of said first, second, and third fluids chemically react to produce a grout.

37. The chemical grout injector of claim 36 wherein any of said first, second, and third fluids that is not used to produce said grout is an additive useful to affect an attribute of said grout.

38. The chemical grout injector of claim 36 wherein one of said first, second, and third fluids is a catalyst and another of said first second and third fluids is a first resin.

39. The chemical grout injector of claim 38 including a second resin useful to produce a second type of a grout.

40. The chemical grout injector of claim 1 wherein said injector body is generally cylindrical in shape.

41. The chemical grout injector of claim 40 wherein said injector body is less than two inches in diameter.

* * * * *